US009075357B2

(12) United States Patent
Kishi et al.

(10) Patent No.: US 9,075,357 B2
(45) Date of Patent: Jul. 7, 2015

(54) FIXING DEVICE AND IMAGE FORMING APPARATUS INCLUDING SAME

(71) Applicants: Kazuhito Kishi, Kanagawa (JP); Takumi Waida, Kanagawa (JP); Masahiro Samei, Osaka (JP); Hiroshi Ono, Tokyo (JP); Takeshi Yamamoto, Kanagawa (JP); Ippei Fujimoto, Kanagawa (JP); Hiroshi Seo, Kanagawa (JP); Ryota Yamashina, Kanagawa (JP); Yasunori Ishigaya, Kanagawa (JP); Takashi Fujita, Kanagawa (JP)

(72) Inventors: Kazuhito Kishi, Kanagawa (JP); Takumi Waida, Kanagawa (JP); Masahiro Samei, Osaka (JP); Hiroshi Ono, Tokyo (JP); Takeshi Yamamoto, Kanagawa (JP); Ippei Fujimoto, Kanagawa (JP); Hiroshi Seo, Kanagawa (JP); Ryota Yamashina, Kanagawa (JP); Yasunori Ishigaya, Kanagawa (JP); Takashi Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/174,134

(22) Filed: Feb. 6, 2014

(65) Prior Publication Data

US 2014/0227001 A1 Aug. 14, 2014

(30) Foreign Application Priority Data

Feb. 14, 2013 (JP) ..... 2013-026534

(51) Int. Cl.
*G03G 15/20* (2006.01)

(52) U.S. Cl.
CPC ..... *G03G 15/2042* (2013.01)

(58) Field of Classification Search
USPC ..... 399/38, 67–70, 122, 320, 328, 329; 219/216, 619
See application file for complete search history.

(56) References Cited

U.S. PATENT DOCUMENTS

| | | | | |
|---|---|---|---|---|
| 6,337,969 | B1 * | 1/2002 | Takagi et al. | 399/330 |
| 8,063,341 | B2 * | 11/2011 | Iwasaki | 219/216 |
| 2006/0237445 | A1 * | 10/2006 | Nagahira et al. | 219/619 |

FOREIGN PATENT DOCUMENTS

| | | |
|---|---|---|
| JP | 6-095540 | 4/1994 |
| JP | 9-096991 | 4/1997 |
| JP | 2001-343860 | 12/2001 |
| JP | 2005-181946 | 7/2005 |

OTHER PUBLICATIONS

U.S. Appl. No. 14/161,078, filed Jan. 22, 2014.
U.S. Appl. No. 14/173,171, filed Feb. 5, 2014.
U.S. Appl. No. 14/167,121, filed Jan. 29, 2014.
U.S. Appl. No. 14/168,357, filed Jan. 30, 2014.

* cited by examiner

*Primary Examiner* — Hoan Tran
(74) *Attorney, Agent, or Firm* — Oblon, McClelland, Maier & Neustadt, L.L.P.

(57) ABSTRACT

A fixing device includes a rotatable fixing member to rotate while contacting an unfixed image; a pressure member to form a fixing nip with the fixing member; a heating member having a plurality of heating elements divided in a direction perpendicular to a conveyance direction of a sheet; a heat performance sensor to detect heating performance of each heating element of the heating member, and a controller to control the heating member. The controller controls each heating element independently such that a temperature of a portion of the fixing member corresponding to a blank area becomes lower than the temperature of a portion of the fixing member corresponding to an image area; and controls the temperature to be maintained at each heating element based on the detection result of the heating performance of each heating element detected by the heat performance sensor.

8 Claims, 9 Drawing Sheets

FIXING DEVICE AND IMAGE FORMING APPARATUS INCLUDING SAME

CROSS-REFERENCE TO RELATED APPLICATIONS

The present application claims priority pursuant to 35 U.S.C. §119 from Japanese patent application numbers 2013-026534, and 2013-263684, filed on Feb. 14, 2013, and Dec. 20, 2013, respectively, the entire disclosures of which are incorporated by reference herein.

BACKGROUND

1. Technical Field

The present invention relates to a thermally heated fixing device for use in an image forming apparatus employing electrophotography, and to an image forming apparatus such as a printer, a facsimile machine, a copier, and the like, including such a fixing device.

2. Related Art

In image forming apparatuses such as copiers, printers, and facsimile machines, a toner image is formed on an image carrier based on image data, the thus-formed toner image is transferred on a recording medium such as a sheet of paper or OHP film, and the recording medium carrying the toner image thereon is treated by a fixing device that fixes the toner image onto the recording medium using heat and pressure.

Fixing devices employing heated rollers are configured using a fixing roller and a pressure roller opposed to the fixing roller. The fixing roller is heated either directly or indirectly by a heat source such as a halogen heater or a heat coil employing induction heating. The two rollers are pressed against each other to form an area of contact across that is herein referred to as a nip portion. The recording medium carrying the image thereon is passed through the nip portion, so that toner forming the toner image is fused and fixed onto the recording medium using heat and pressure. The fixing roller method is widely employed due to its safety and its adaptability to high-speed printers.

The fixing roller has a metal core having a high thermal capacity. As a result, it takes several minutes for the fixing roller to reach a target temperature suitable for fixing the toner image on the recording medium. Therefore, this type of fixing roller must maintain a certain temperature even during standby when image formation is not performed, consuming a large amount of energy in the process.

A more energy-efficient type of fixing device that is frequently used is one employing a belt or a film, in which an insulation roller is heated externally, and further, only the area of the recording medium on which an image is formed is selectively heated based on the image data.

For example, there are configurations in which a planar heating member that contacts a cylinder of thin, heat-resistant film and a pressure roller together sandwich the film and the recording medium and press them against each other to impart thermal energy to the recording medium. Because the film is as thin as approximately 100 μm, the actual warm-up time is only the length of time needed to raise the temperature of the planar heating member having a low thermal capacity. Accordingly, the warm-up time can be shortened, thereby reducing the amount of power needed to warm up. Energy is saved by reducing power supply to a blank area (where no image exists on the recording medium), by changing a control temperature of the heating member and the area to be heated based on the image formed on recording medium.

Other approaches measure the temperature of each of multiple heat generators of a thermal heater and supply heat as appropriate, taking into account ambient temperature, and further, heating only the toner portions of the recording medium.

Additionally, the fixing roller may be heated externally. If the roller is heated from the outside, the heat remaining on the surface of the fixing roller can be used for fusing toner. Thus, the warm-up time is shortened compared to the internal-heating method that heats the entire fixing roller, thereby reducing energy loss. Moreover, the fixing device may be configured to selectively heat the image area alone and includes a second set temperature that is lower than the fixing temperature.

However, fixing devices that selectively heat the image area alone have a plurality of heating elements in both a sheet conveyance direction and the direction perpendicular to the sheet conveyance direction. In this case, each heating element may include variations in the heating due to initial or cumulative changes derived from manufacturing errors that in turn may produce high electrical density area and low electrical density areas.

Further, variations in the temperature of the belt that contacts the unfixed or blank image degrade image quality and cause defective image formation.

SUMMARY

The present invention aims to suppress uneven temperature on the surface of the fixing member so that the formed image quality is improved, thereby suppressing an excess power supply and reducing power consumption.

The present invention provides an improved fixing device that includes a rotatable fixing member to rotate while contacting an unfixed image on a sheet of recording medium; a pressure member to form a fixing nip portion with the fixing member; a heating member divided into a plurality of individual heating elements in a direction perpendicular to a conveyance direction of a sheet of recording medium; a heat performance sensor to detect heating performance of each heating element of the heating member, and an controller to control the heating member. Image fixing is performed by passing the sheet of recording medium carrying an unfixed image thereon through the nip portion. The controller controls each heating element independently such that a temperature of a portion of the fixing member corresponding to a blank area on the recording medium becomes lower than the temperature of a portion of the fixing member corresponding to an image area. The external heater further controls the temperature to be maintained at each heating element based on the detection result of the heating performance of each heating element detected by the heat sensor.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will be described with reference to accompanying drawings.

Figure 1:
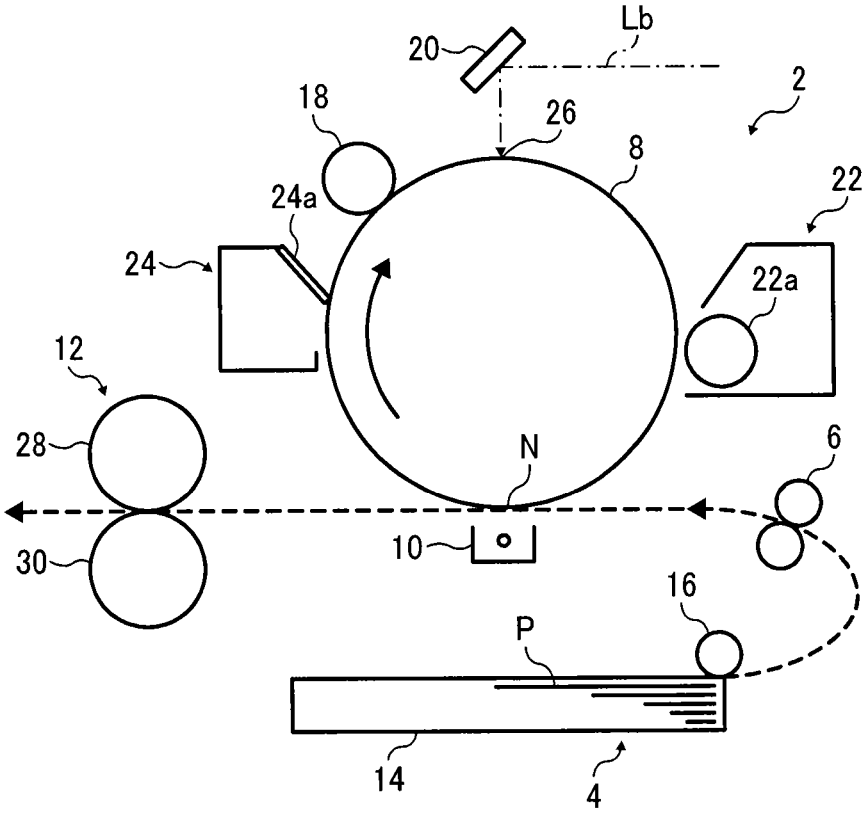
FIG. 1 is a schematic cross-sectional view of an image forming apparatus according to an embodiment of the present invention.

FIG. 1 is a cross-sectional view of an image forming apparatus 2 according to an embodiment of the present invention. In the present embodiment a printer is used as an example of the image forming apparatus 2 according to the present invention, which includes a sheet feeder 4, a registration roller pair 6, a photoreceptor drum 8 as an image carrier, a transfer device 10, and a fixing device 12.

The sheet feeder 4 is constructed of a paper tray 14 and a sheet feed roller 16. The paper tray 14 contains multiple sheets P of recording media stacked thereon. The sheet feed roller 16 separates and sends each sheet one by one from the top of the stacked sheets. The sheet P sent out by the sheet feed roller 16 is once stopped by the registration roller pair 6, which corrects an alignment error of the sheet P. Then, the sheet P is sent to a transfer portion N by the registration roller pair 6 in synchrony with a rotation of the photoreceptor drum 8, that is, when a leading end of the toner image formed on the photoreceptor drum 8 is aligned with a predetermined position of a leading end of the sheet P in the conveyance direction.

Around the photoreceptor drum 8, a charging roller 18, a mirror 20, a part of exposure means, a developing device 22 including a developing roller 22*a*, a transfer device 10, and a cleaning device 24 including a cleaning blade 24*a* are sequentially disposed along the rotation direction of the photoreceptor drum 8. An exposure portion 26 of the photoreceptor drum 8 is irradiated with light Lb via the mirror 20 at a position between the charging roller 18 and the developing device 22 and scanning is performed.

Image formation in the image forming apparatus 2 is performed similarly as in the conventional method. Specifically, when the photoreceptor drum 8 starts to rotate, the surface of the photoreceptor drum 8 is charged uniformly by the charging roller 18 and the surface of the photoreceptor drum 8 is irradiated and scanned with the exposure light Lb based on the image data to create a latent image corresponding to the image to be formed.

This latent image is moved by the rotation of the photoreceptor drum 8 to a position opposed to the developing device 22 where the toner is supplied to the latent image, so that the latent image is rendered visible and the toner image is formed. The toner image formed on the photoreceptor drum 8 is transferred onto the sheet P that has entered into a transfer portion N at a predetermined timing, via application of a transfer bias by the transfer device 10. The sheet P, on which the toner image has been carried, is then conveyed to the fixing device 12 and is fixed onto the sheet P by the fixing device 12. The sheet P is then discharged onto a paper discharge tray, not shown, and is stacked thereon.

Residual toner remaining on the photoreceptor drum 8 without being transferred at the transfer portion N is conveyed along with the rotation of the photoreceptor drum 8 to the cleaning device 24 and is scraped off from the photoreceptor drum 8 by the cleaning blade 24*a* when passing through the cleaning device 24, so that the surface of the photoreceptor drum 8 is cleaned. Thereafter, the residual electric potential on the photoreceptor drum 8 is removed by a discharger, not shown, and the photoreceptor drum 8 is prepared for a next image formation process.

Figure 2:
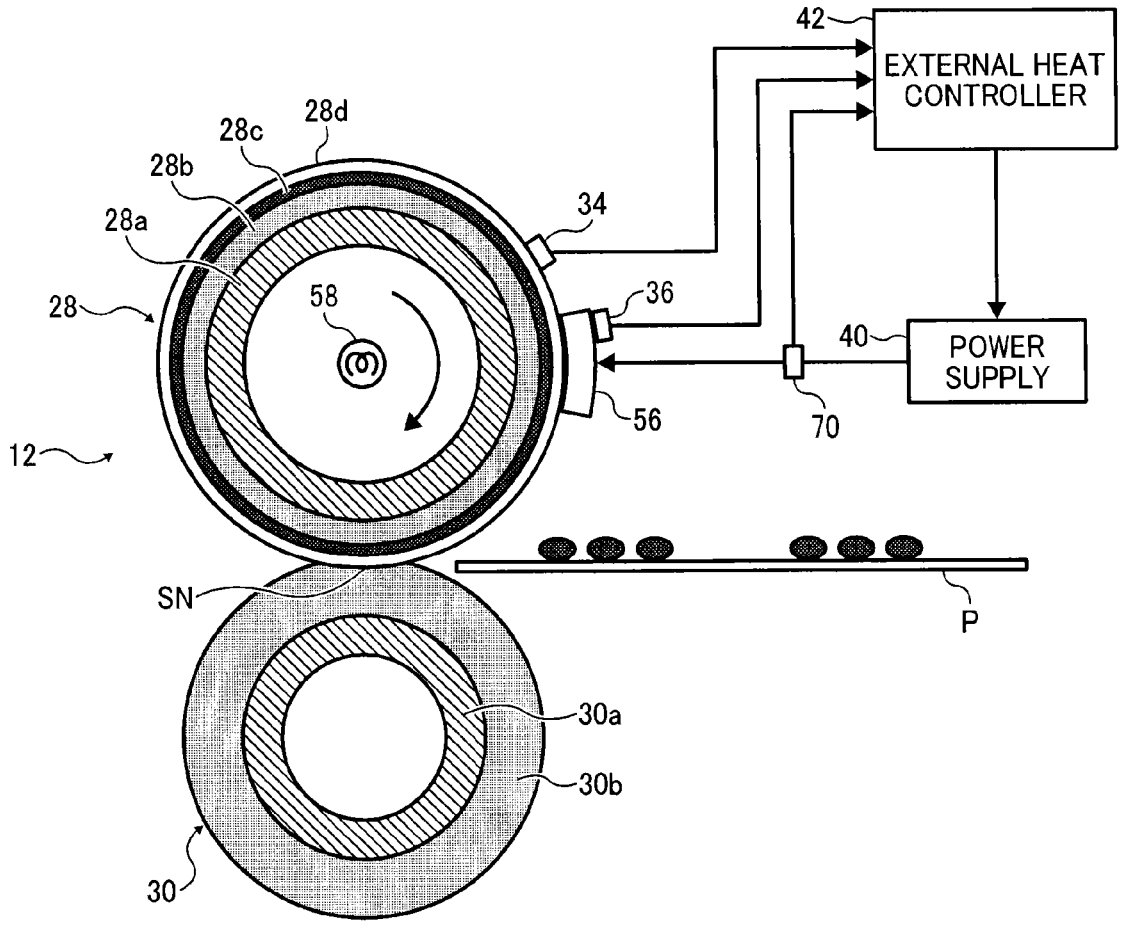
FIG. 2 is a schematic cross-sectional view of a fixing device according to an embodiment of the present invention.
Figure 3:
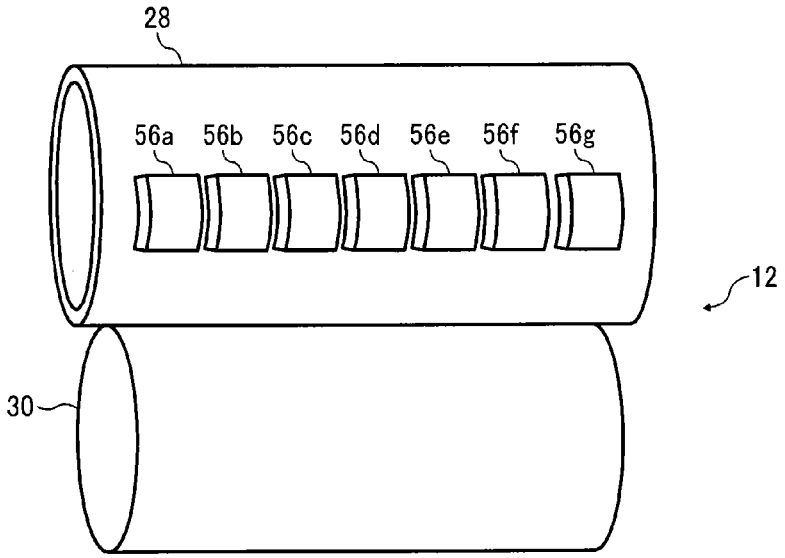
FIG. 3 is a perspective view of a fixing device according to the first embodiment of the present invention.

As illustrated in FIGS. 2 and 3, the fixing device 12 according to a first embodiment employs an external heating method. That is, the fixing device 12 is constructed of a fixing roller 28, a pressure roller 30, a thermal heater 56, a heat sensor 70, and the like. The fixing roller 28 rotatably contacts an unfixed-image to serve as a fixing member. The pressure roller 30 presses against the fixing roller 28 and forms a fixing nip portion SN along with the fixing roller 28. The thermal heater 56, located outside the fixing roller 28 and supplied with power from a commercial power supply 40, heats the fixing roller. The heat sensor 70 detects heating of each heating element of the thermal heater 56. The thermal heater 56 and the power supply 40 construct an external heater means.

The thermal heater 56 is constructed of multiple heating elements 56*a*, 56*b*, 56*c*, 56*d*, 56*e*, 56*f*, and 56*g*, which are disposed at equal intervals in the width direction of the sheet P. Each heating element 56*a*, 56*b*, 56*c*, 56*d*, 56*e*, 56*f*, and 56*g* heats a specific heating element and is capable of heat the target independently.

Downstream of the fixing nip portion SN and upstream of the heater 56 in the rotation direction of the fixing roller 28, a thermistor 34 to detect a surface temperature of the fixing roller 28, a thermistor 36 to detect a temperature of the heater 56, the power supply 40 to supply power to the heater 56, and an external heat controller 42 to control the power supply 40 based on the data detected by the thermistors 34, 36, are disposed. The external heat controller 42 is configured as a microcomputer including a CPU, a ROM, a RAM, and an I/O interface, and the like.

The fixing roller 28 is constructed of a metal core 28*a*, formed in this case of aluminum having an external diameter of 40 mm and a thickness of 1 mm, and an insulation layer 28*b* coated onto an outer surface of the metal core 28*a*. In the present embodiment, the insulation layer 28*b* is formed of silicon rubber and has a thickness of 3 mm. The insulation layer 28*b* may be formed of foamed silicon rubber having a property of less thermal diffusion to further increase the thermal insulation property.

A highly thermally conductive layer 28*c* formed of nickel is coated on the insulation layer 28*b* of the fixing roller 28. Materials for use in the highly thermally conductive layer 28*c* are not limited to nickel and alternatively various other materials may be employed, such as ferrous alloys such as stainless steel, metals such as aluminum and copper, and a graphite sheet, as long as its thermal conductivity is greater than that of the insulation layer 28*b*.

Use of the highly thermally conductive layer 28*c* on the fixing roller 28 minimized localized temperature variations on the surface of the fixing roller 28 due to uneven heat generation by the thermal heater 56. If the heat is quickly conducted even in areas between each heating element 56*a*, 56*b*, 56*c*, 56*d*, 56*e*, 56*f*, and 56*g* where no heat generation is performed, fixing errors of the image can be reduced.

Due to the effects of the highly thermally conductive layer 28*c*, the temperature in a relatively wider area than the areas heated by the thermal heater 56 increases, thereby compensating for a slight shift in the formed image. Specifically, the highly thermally conductive layer 28*c* gives flexibility in designing size and location of each heating element 56*a*, 56*b*, 56*c*, 56*e*, 56*e*, 56*f*, or 56*g*.

Further, to improve durability of the fixing roller 28*a* and to secure releasability, the highly thermally conductive layer 28*c*, a release layer, formed of fluorine resins such as tetrafluoroethylene-perfluoroalkyl vinylether copolymer (PFA) or polytetrafluoroethylene (PTFE) and with a thickness of from 5 μm to 30 μm may be disposed on the surface of the insulation layer 28*b*.

The pressure roller 30 is constructed of a metal core 30*a*, in this case formed of iron having an external diameter of 40 mm and a thickness of 2 mm, and an elastic layer 30*b* coated on a surface of the metal core 30*a*. The insulation layer 30*b* is formed of silicon rubber and has a thickness of 5 mm. Preferably, a fluorine resin layer having a thickness of approximately 40 μm is provided on a surface of the elastic layer 30*b* to increase releasability.

The pressure roller 30 is pressed against the fixing roller 28 via a biasing member, not shown. The heater 56 is pressed against the fixing roller 28 via a biasing member, not shown.

Heating of each heating element 56*a*, 56*b*, 56*c*, 56*e*, 56*e*, 56*f*, or 56*g* is controlled based on image data, which will be described below, so that energy saving is achieved.

If the heating efficiency of the thermal heater 56 is low and the surface temperature of the fixing roller 28 cannot be appropriately increased up to a predetermined fixing temperature, the fixing roller 28 is also heated by a built-in halogen heater 58 disposed in the fixing roller 28 up to a slightly lower temperature than the fixing temperature and the thermal heater 56 is used to heat the portion corresponding to the image area, thereby reducing energy consumption.

If the image is formed over the entire surface of the sheet P, the fixing roller 28 needs to be heated entirely. Accordingly, heating control based on the image data is not necessary. In such a case, the fixing roller 28 need be heated only by the halogen heater 58 up to a fixing temperature. Optionally, both the halogen heater 58 and the thermal heater 56 may be energized only when the printer is initially activated to heat the fixing roller 28, to shorten the warm-up.

Next, heating control will be described.

The external heat controller 42 controls the thermal heater 56 by changing heating ratio of each heating element 56*a*, 56*b*, 56*c*, 56*e*, 56*e*, 56*f*, or 56*g* selectively based on the image data of the image to be formed on the sheet P.

Figure 4A:
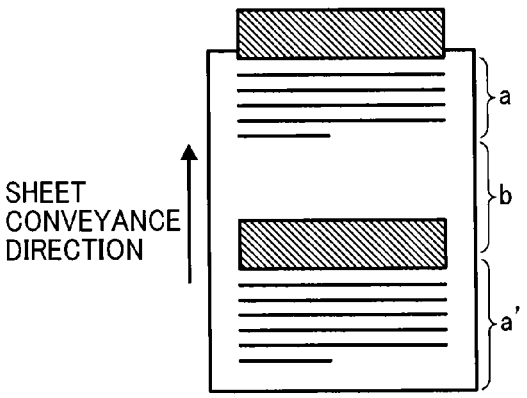
FIGS. 4A and 4B each illustrate an image area and a blank area on a sheet of paper.
Figure 4B:
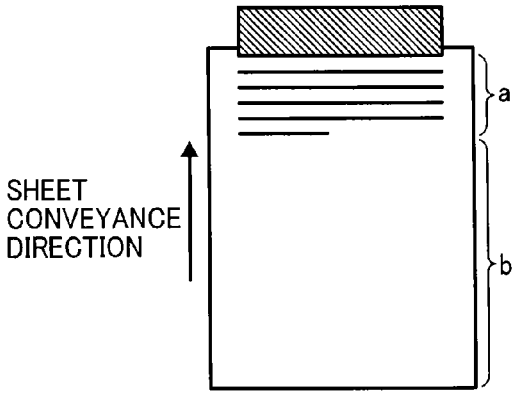

FIGS. 4A and 4B each illustrate an image area and a blank area formed on the sheet P. FIG. 4A shows an image formation pattern on the sheet P sequentially from a leading end of the sheet P in the sheet conveyance direction, including an image area a, a blank area b, and an image area a'. Fixing should be done in the image areas a and a' in which toner as a target for fixation exists; however, because there is no image in the blank area b and the toner as a target for fixation does not exist, fixing operation is not required.

FIG. 4B shows an image formation pattern on the sheet P sequentially from a leading end of the sheet P in the sheet conveyance direction, including an image area a and a blank area b. The image area a in which the toner as a target for fixation exists requires fixation; however, because there is no image in the blank area b and the toner as a target for fixation does not exist, fixing operation is not required.

Figure 5A:
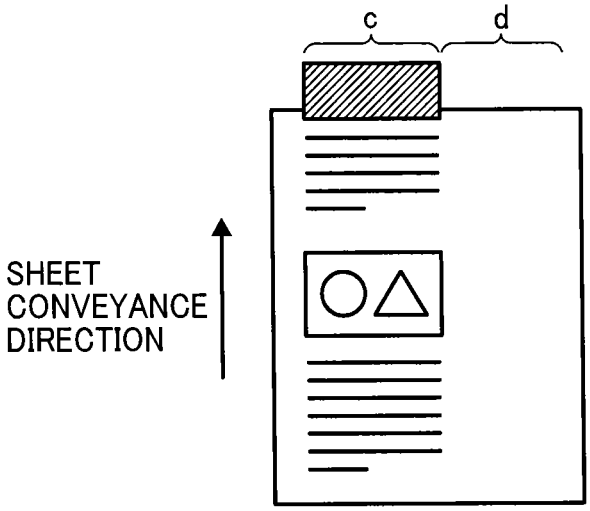
FIGS. 5A and 5B each illustrate an image area and a blank area on a sheet of paper.
Figure 5B:
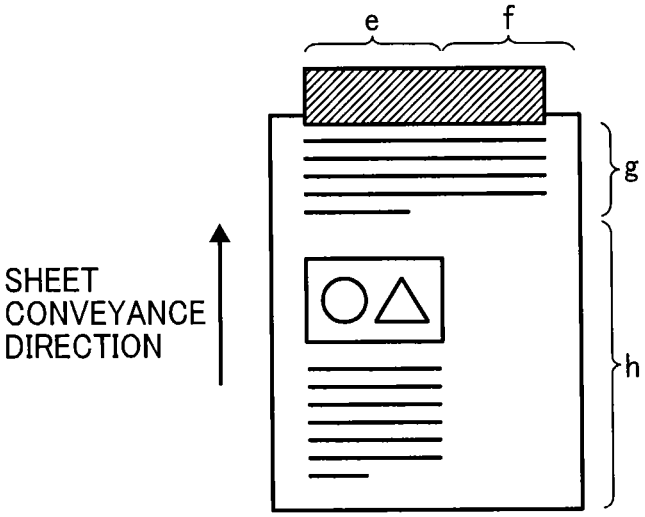

FIGS. 5A and 5B each illustrate an image area and a blank area formed on the sheet P. FIG. 5A shows an image formation pattern in which an image area c and a blank area d exist in a longitudinal direction of the fixing roller, that is, in a direction perpendicular to the conveyance direction of the sheet P. The image area c in which the toner as a target for fixation exists, requires fixation; however, because there is no image in the blank area d and the toner as a target for fixation does not exist, fixing operation is not required.

FIG. 5B shows an image formation pattern on the sheet P in which an image area e in the direction perpendicular to the conveyance direction of the sheet P, an image area f on the leading end of the conveyance direction of the sheet P, and a blank area h in the sheet conveyance direction of the sheet P exist. The image areas e and f in which the toner as a target for fixation exists requires fixation; however, because there is no image in the blank area h, fixing operation is not required.

How the external heat controller 42 controls the power supply 40 and the heater 56 will be described. As illustrated in FIG. 4A, when the image data corresponding to the image pattern is input from an image processor (illustrated in FIG. 9) to the external heat controller 42, the external heat controller 42 controls the power supply 40 and the heater 56 such that the temperature of the portion of the fixing roller 28 corresponding to the blank area b becomes lower than that of the portions of the fixing roller 28 corresponding to the image area a and the image area a'.

Herein, 'the portion of the fixing roller 28 corresponding to the image area or the blank area' means the portion of the fixing roller 28 closely contacting the image area or the blank area on the sheet P. Specifically, the external heat controller 42 controls the power supply 40 to apply power to all the heating elements 56*a* to 56*g* such that the portion of the fixing roller 28 corresponding to the image area a existing over an entire length of the sheet P can obtain a predetermined fixing temperature; and to reduce power to be applied to the portion of the fixing roller 28 corresponding to the blank area b. Then, the external heat controller 42 controls the power supply 40 to apply power again to the heating elements 56*a* to 56*g* such that the portion of the fixing roller 28 corresponding to the image area a' in the trailing end of the sheet P can gain the fixing temperature.

Similarly, as illustrated in FIG. 4B, the external heat controller 42 controls the power supply 40 to supply power to all the heating elements 56*a* to 56*g* such that the portion of the fixing roller 28 corresponding to the image area a and to reduce power to be supplied to the portion of the fixing roller 28 corresponding to the blank area b.

Referring to FIG. 5A, the external heat controller 42 controls the power supply 40 to supply power to the heating elements 56*a* to 56*g* such that the portion of the fixing roller 28 corresponding to the image area c existing over a half the width of the sheet P can obtain a predetermined fixing temperature. Specifically, the external heat controller 42 controls the power supply 40 to reduce power to be supplied to the heating elements 56*e* to 56*g* than the power to be supplied to the heating elements 56*a* to 56*d* such that the temperature of the portion of the fixing roller 28 corresponding to the blank area d becomes lower than that of the portion of the fixing roller 28 corresponding to the image area c.

Referring to FIG. 5B, the external heat controller 42 controls the power supply 40 to supply power to an entire area of the heating elements 56*a* to 56*g* such that the portion of the fixing roller 28 corresponding to the image area g existing over an entire width of the sheet P can obtain a predetermined fixing temperature. Thereafter, the external heat controller 42 controls the power supply 40 to supply power to the heating elements 56*a* to 56*g* such that the portion of the fixing roller 28 corresponding to the image area e existing over a half the width of the sheet P can obtain a predetermined fixing temperature, that is, increase power to be supplied to the heating element 56*a* to 56*d* than that to be supplied to the heating elements 56*e* to 56*g*.

In this case, the power is supplied actually at a shaded portion in the figure. The shaded portion is a preliminary heating area that is preliminarily heated for each of the heating elements 56*a* to 56*g* and the power is supplied before each image area enters the nip portion. The preliminary heating area is provided considering the length of the heater in the circumferential direction and the necessity of the temperature rising time required for the heater itself. The preliminary heating area is preferably as small as possible to save energy.

It may be thought that the external heat controller 42 controls the power supply 40 to heat the heating member 56 to shut off completely at the portion corresponding to the blank area b, d, or h of the fixing roller 28. However, if the temperature of the fixing roller 28 decreases too low, warming up to reach the fixing temperature for a next image area (i.e., the image area a' in FIG. 4A) will be delayed. As a result, it is preferred that the temperature of the fixing roller 28 be maintained at a predetermined temperature or greater by supplying power either intermittently or at a reduced strength to the heaters.

Figure 10:
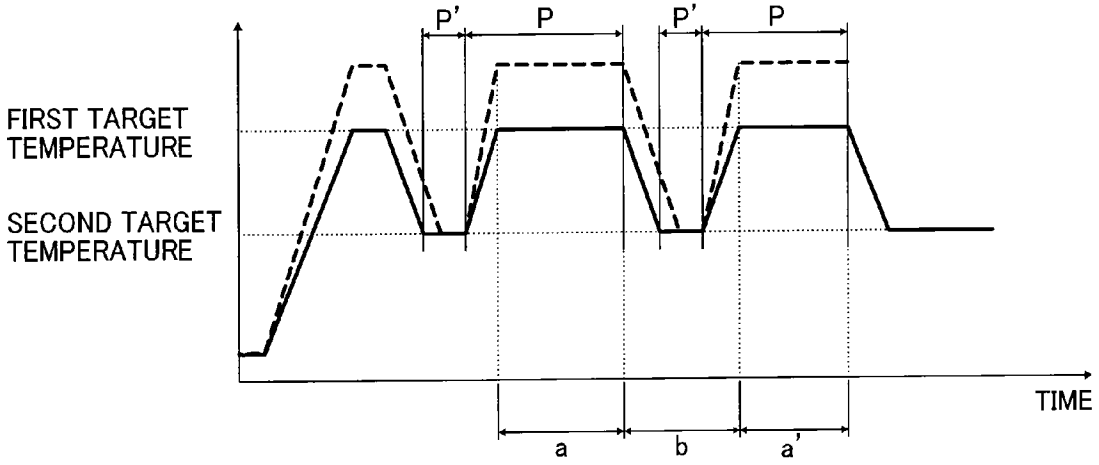
FIG. 10 is a graph illustrating a relation between a target temperature for the fixing device and time.

FIG. 10 is a graph illustrating a relation between a target temperature for the fixing roller and time in the image formation pattern as illustrated in FIG. 4A. As illustrated in FIG. 10, the temperature of the fixing device is set to a first target temperature in the image areas a and a' and the temperature of the fixing roller is set at a second target temperature which is higher than room temperature and lower than the first target temperature in the blank area b. Similarly, in the image formation patterns of FIGS. 4B, 5A, and 5B, each heating element 56 to 56*g* is controlled such that the temperature of the fixing roller is set at the first target temperature in the image area and the temperature of the fixing roller is set at the second target temperature in the blank area b.

As a result, supplying power to the heater is performed even in the portion corresponding to the blank areas b, d, and h, but the supplied power is reduced. Specifically, because the to-be-supplied power in area P' is lower than that in area P, the second target temperature in addition to the first target temperature are used for controlling, thereby achieving energy saving.

In the present embodiment, a structure in which the heater 56 is contacted against the surface of the fixing roller 28 and heats the fixing roller 28 is adopted. However, the external heat controller 42 can be formed of a coil and an inverter so that the fixing roller 28 is heated by the non-contact induction heating (IH) method. An excitation coil is formed such that 50 to 500 insulation-coated electrical leads each having a diameter $\phi$ of from approximately 0.05 to 0.2 mm are wound together to form a litz wire with 5 to 15 windings. With this method as well, the temperature of the fixing roller 28 can be controlled based on the image data and an energy saving effect is exerted similarly.

Next, as described referring to FIGS. 6 and 7, the fixing device 12 according to a second embodiment of the present invention will be described.

Figure 6:
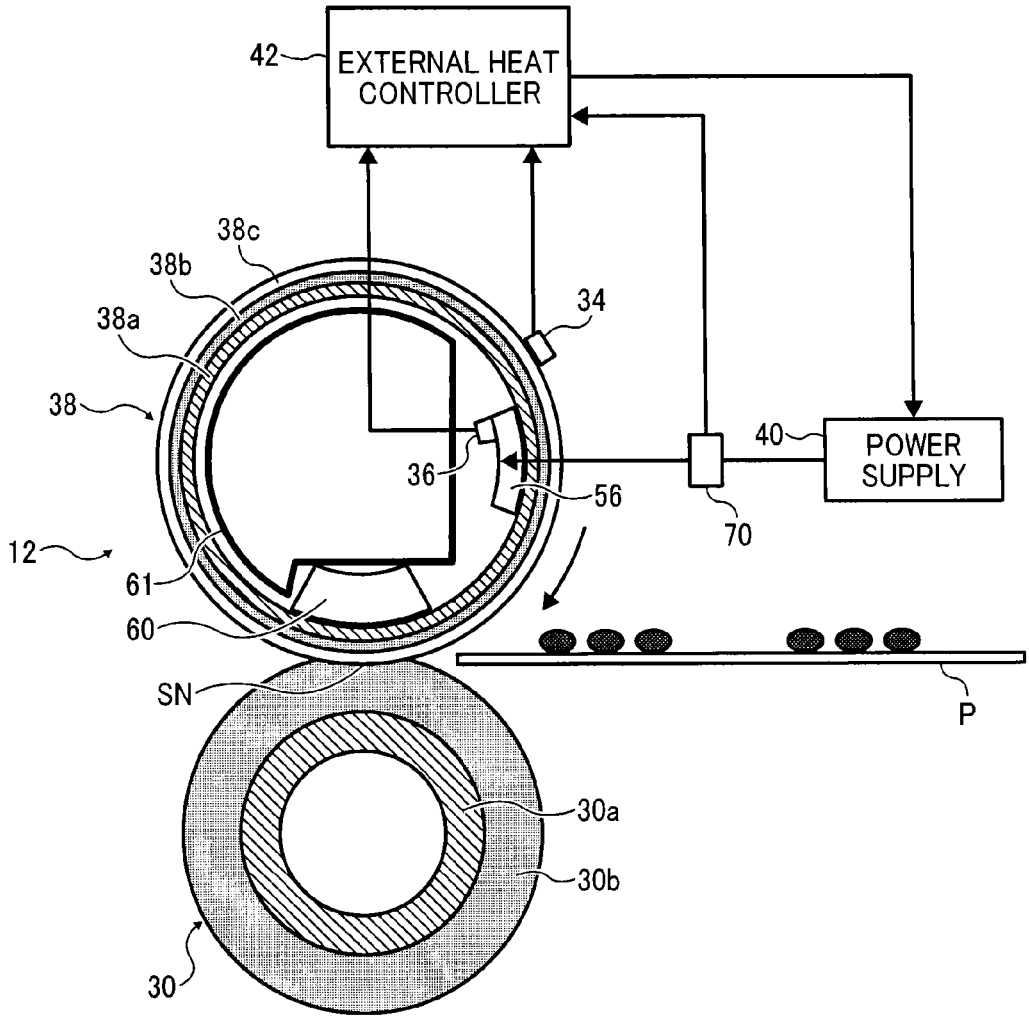
FIG. 6 is a schematic cross-sectional view of a fixing device according to a second embodiment of the present invention.

FIG. 6 is a schematic cross-sectional view of the fixing device 12 according to the second embodiment of the present invention. The fixing device 12 according to the second embodiment includes a thermal or ceramic heater 56. The heater 56 is constructed of a planar base and heating elements formed on the planar base. The thermal heater 56 is disposed inside a belt or film and provides heat to the belt or film to increase temperature, so that the unfixed image conveyed to the fixing nip portion SN is heated and fixed.

The thermal heater 56 is disposed upstream of the fixing nip portion SN because a certain length of time is required for the heat from the thermal heater 56 disposed inside the belt or film to reach a surface of the fixing roller 28. Alternatively, the thermal heater 56 may be disposed in the vicinity of the fixing nip portion SN. This arrangement may also be applied to the external heating method.

Figure 7:
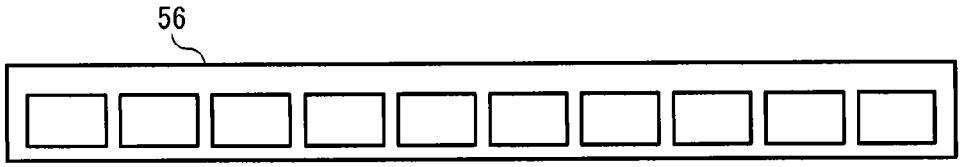
FIG. 7 is a schematic view of a heater divided into ten portions.

As illustrated in FIG. 7, the thermal heater 56 as a planar heating member is divided into a plurality of heating elements in the direction perpendicular to the sheet conveyance direction and heating each heating elements can be controlled independently. In the present embodiment, the heater is divided into ten areas.

The fixing belt 38 as a fixing device includes a base member 38*a* formed of a stainless steel (SUS) having an external diameter of 40 mm and a thickness of 40 μm, and an elastic layer 38*b* coated on a surface of the base member 38*a*. The elastic layer 38*b* is formed of silicon rubber and has a thickness of 100 μm.

Further, a release layer 38*c* formed of fluorine resins such as tetrafluoroethylene-perfluoroalkyl vinylether copolymer (PFA) or polytetrafluoroethylene (PTFE) having a thickness of from 5 μm to 50 μm is formed on an external surface of the elastic layer 38*b* to improve durability and releasability. The base member 38*a* of the fixing belt 38 may employ polyimide as a material.

A support member 61 is disposed inside the fixing belt. A pressure member 60 is disposed inside the fixing belt at the nip portion SN and is connected to an external member, not shown, so as to support the fixing device.

Although not illustrated, the belt or film structure of the thermal heater 56 as illustrated in FIG. 6 may be applied to the external heating method as illustrated in FIG. 2.

Figure 8:
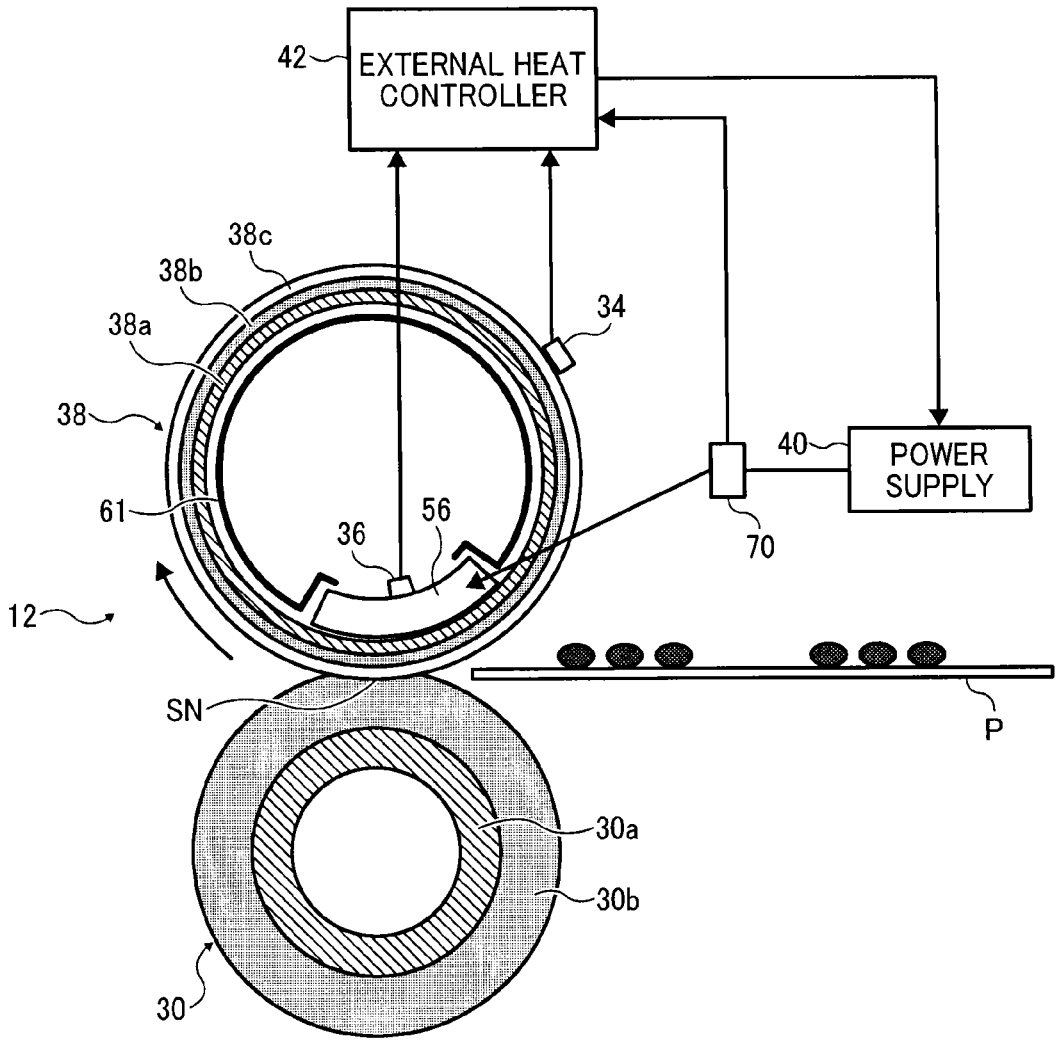
FIG. 8 is a schematic cross-sectional view of a fixing device according to a third embodiment of the present invention.

FIG. 8 illustrates a fixing device 12 according to a third embodiment of the present invention. As illustrated in FIG. 8, the thermal heater 56 as the planar heating member may be disposed at the fixing nip portion SN. With this structure, the thermal heater 56 may be used as a pressing member as well. The structure other than the above is the same as the second embodiment.

Figure 9:
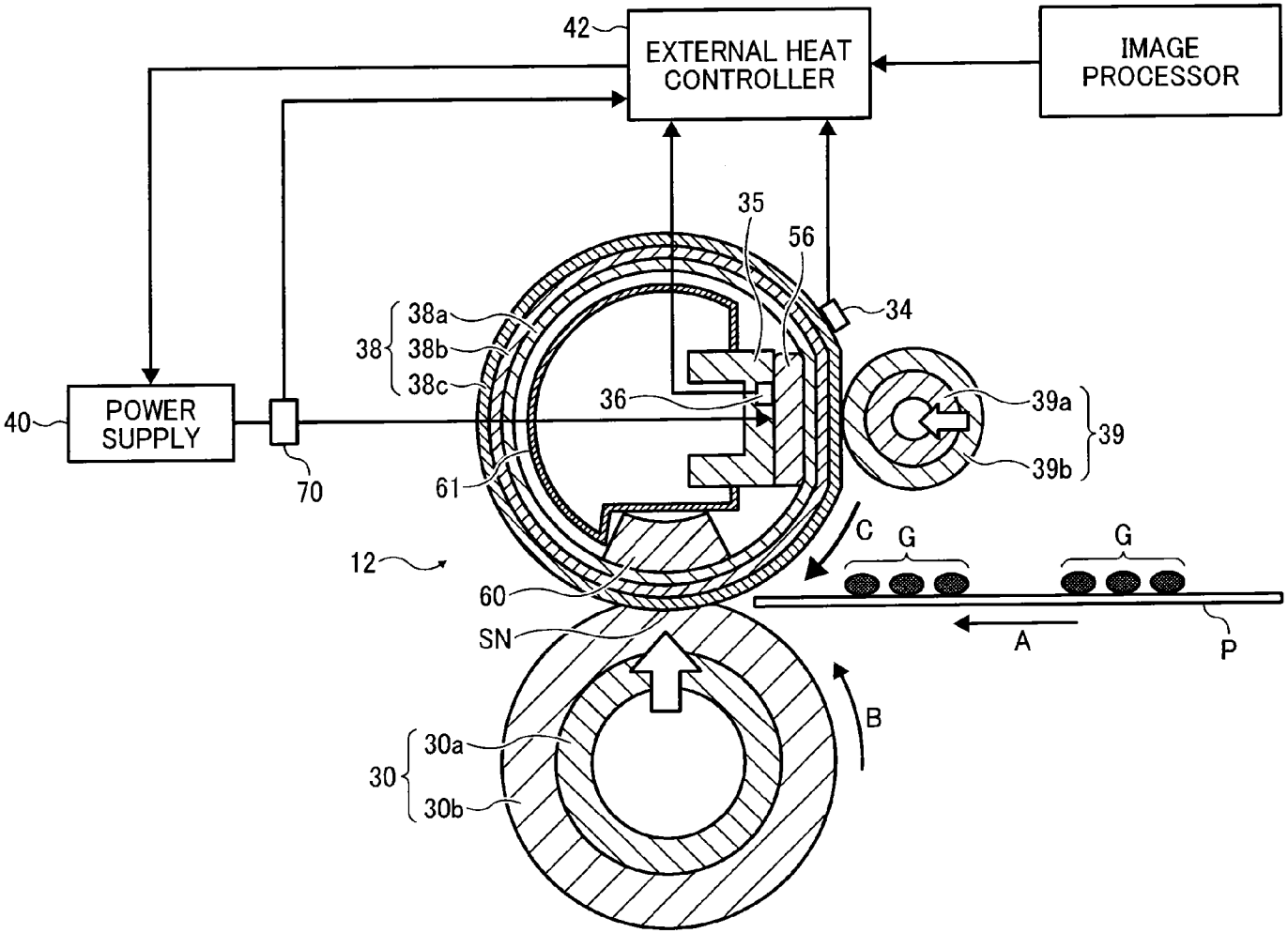
FIG. 9 is a schematic cross-sectional view of a fixing device according to a fourth embodiment of the present invention.

FIG. 9 illustrates a fixing device 12 according to a fourth embodiment of the present invention.

As illustrated in FIG. 9, the fixing device 12 includes a fixing belt 38 as a fixing rotary member, a pressure roller 30 as an opposite member configured to contact the fixing belt 38 and form a nip portion SN, and a heater 56 configured to heat the fixing belt 38. A contact surface between the heater 56 and the fixing belt 38 is a substantially flat plane.

The fixing belt 38 is formed of a thin, flexible endless belt. Specifically, the fixing belt 38 is constructed of a base member 38*a* formed of a stainless steel (SUS) having an external diameter of 40 mm and a thickness of 40 μm, an elastic layer 38*b* coated to have a thickness of 100 μm on a circumferential surface of the base member 38*a*, and a release layer 38*c* formed of fluorine resins such as tetrafluoroethylene-perfluoroalkyl vinylether copolymer (PFA) or polytetrafluoroethylene (PTFE) coated to have a thickness of from 5 μm to 50 μm on a circumferential surface of the elastic layer 38*b*. The base member 38*a* of the fixing belt 38 may employ resin materials such as polyimide.

The pressure roller 30 is constructed of a metal core 30*a* formed of iron having an external diameter of 40 mm and a thickness of 2 mm, and an elastic layer 30*b* coated on a surface of the metal core 30*a*. The insulation layer 30*b* of the pressure roller 30 is formed of silicon rubber and has a thickness of 5 mm. Preferably, a fluorine resin layer having a thickness of approximately 40 μm is provided on a circumferential surface of the elastic layer 30*b* to increase releasability.

In addition, a nip forming member 60, as a pressure member, is disposed at a position opposite the pressure roller 30 which is disposed on an interior surface of the fixing belt 38. The nip forming member 60 is supported by a side plate, not shown, of the fixing device 12 at both lateral ends thereof. The pressure roller 30 which is pressed by a pressure lever, for example, and the nip forming member 60 are pressed against each other to form a press-contacted portion, that is, a nip or nip portion SN having a predetermined width. The rotary fixing member and the opposite member may be simply configured to contact each other without being applied with pressure.

Further, the pressure roller 30 is configured to rotate by a driving source such as a motor, not shown, in Arrow B direction in the figure. Further, when the pressure roller 30 is driven to rotate, the driving force of the pressure roller 30 is transmitted to the fixing belt 38 at the nip portion SN, so that the fixing belt 38 is driven to rotate in Arrow C direction in the figure. In an interior of the fixing belt 38, the belt support member 61 to support the fixing belt 38 is disposed.

The thermal or ceramic heater 56 is constructed of a planar or planar heat generator. A stay 35, a support member, is disposed on the interior surface of the fixing belt 38. The stay 35 supports the heater 56 to oppose to the interior surface of the fixing belt 38 further upstream in the sheet conveyance direction A than the nip portion SN. The heater 56 is connected to the power supply 40 and power is supplied from the power supply 40 to the heater 56. Output of the power supply 40 is controlled by the external heat controller 42. Herein, the external heat controller 42 is configured as a microcomputer including a CPU, a ROM, a RAM, and an I/O interface, and the like.

In addition, the fixing device 12 includes a first thermistor 36 to detect a temperature of the heater 56 and a second thermistor 34 to detect a temperature of the fixing belt 38. The first thermistor 36 directly contacts the heater 56 and the second thermistor 34 is disposed opposite the circumferential surface of the fixing belt 38 at a position farther upstream than the heater 56 in the belt rotation direction C. Data of the temperature detected by each thermistor 36 or 34 is input to the external heat controller 42. Based on the input data, the external heat controller 42 controls output from the power supply 40.

In addition, a pressure roller 39, as a pressure member to press against the fixing belt 38, is disposed on a circumferential surface of the fixing belt 38 opposite the heater 56. The pressure roller 39 presses the fixing belt 38 against the heater 56, and thus, the fixing belt 38 contacts the heater 56. The pressure roller 39 is constructed of a metal core 39*a* formed of iron having an external diameter of 15 to 30 mm and a thickness of 8 mm, and an elastic layer 39*b* formed of silicon rubber having a thickness of from 3.5 mm to 11 mm coated on a circumferential surface of the metal core 39*a*. In addition, it is preferred that a release layer formed of fluorine resin having a thickness of approximately 40 μm be provided on a circumferential surface of the elastic layer 39*b* to increase releasability. The pressure roller 39 is pressed against the fixing belt 38 by a biasing member, not shown, but may be simply contacted the fixing belt 38 without being given a pressing force.

Next, with reference to FIG. 9, operation of the fixing device according to the present embodiment will be described.

When the power to the current apparatus is turned on, the pressure roller 30 starts to rotate in Arrow B direction at the same time when the power is supplied from the power supply 40 to the heater 56. As a result, the fixing belt 38 is driven to rotate in Arrow C direction by the friction power between the fixing belt 38 and the pressure roller 30.

Thereafter, when the sheet P carrying an unfixed toner image G thereon after the image forming process as described above is conveyed to the nip portion SN between the fixing belt 38 and the pressure roller 30, the sheet P is heated and pressed so that the toner image G on the sheet P is fixed. Then, after the sheet P having been conveyed from the nip portion SN, the sheet P is discharged outside the image forming apparatus.

As described above, each heating element of the heater is independently heated and controlled based on image data. However, each heating element performs somewhat differently due to initial or cumulative changes derived from manufacturing errors, and both high electrical density areas and low electrical density areas may exist.

Referring to FIG. 10, a dotted line indicates a heightened heating performance. At an initial start-up time of the image forming apparatus (that is, when the power is turned on), the heater is caused to be heated at substantially 100% power from room temperature to the first target temperature. In this case, the area in which heating performance is high reaches the first target temperature earlier than the predetermined time and then reaches the first target temperature from the second target temperature as a target temperature for the blank image. Thus, the image area tends to be heated to a temperature higher than the first target temperature.

If there are variations in the heating performance, the portion of the belt contacting the unfixed image tends to be heated excessively, thereby causing defective image formation.

Figure 11:
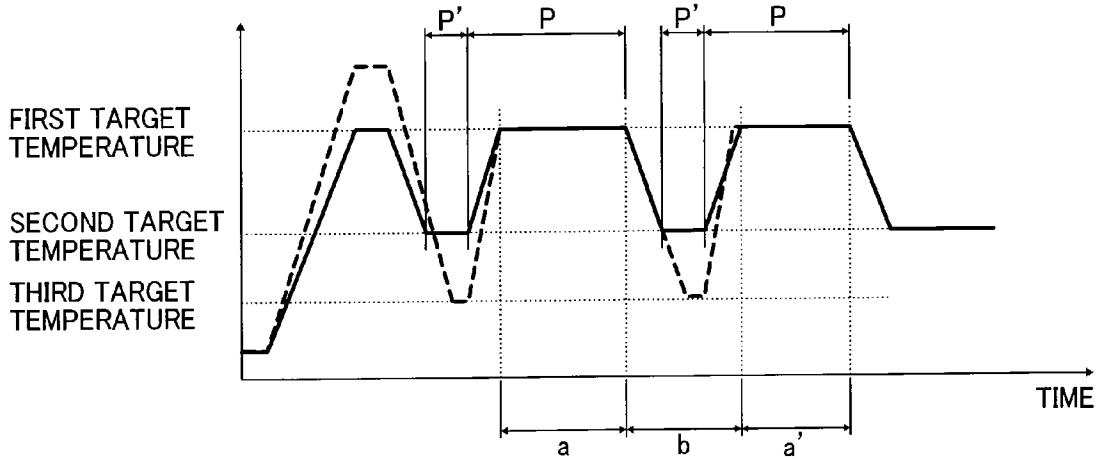
FIG. 11 is a graph illustrating a relation between a target temperature for the fixing device and time.

FIG. 11 is a graph illustrating a relation between a target temperature for the fixing member and time, in which the following heating control is applied to the fixing device 12 according to the first to third embodiments of the present invention.

The fixing device 12 includes the heat sensor 70 to detect heating of each of the plurality of heating elements. The heat sensor 70 detects a warm-up time period of the surface of the fixing member up to the first target temperature at which the unfixed toner can be heated, fused, and fixed in the heating-up operation of the fixing device upon activation of the image forming apparatus, for example. The heat sensor 70 detects the warm-up time for each heating element among the plurality of heating elements. The external heat controller 42 controls the temperature to be maintained at each heating element based on the heating of each heating element detected by the heat sensor 70.

When the temperature of the heater 56 increases to the first target temperature as illustrated by a solid line in FIG. 11, it is determined that the warm-up time of the heater 56 is substantially equal to the predetermined time and the heater 56 operates normally. In this case, the target temperature of the fixing member 28 or 38 heated by the heater 56 is controlled similarly to the control as illustrated in FIG. 10. Specifically, the external heat controller 42 maintains the first target temperature for the image areas and the second target temperature for the blank areas on the recording medium.

On the other hand, if the temperature of a heater 56 increases to the first target temperature as illustrated by a dotted line in FIG. 11, the warm-up time is shorter than the predetermined time. Then, it is determined that the heater 56 operates at higher than average capacity. In this case, the external heat controller 42 maintains, for the blank areas, a third target temperature which is lower than the second target temperature. The temperature of such a heater 56 can increase the temperature of the fixing member 28 or 38 from the third target temperature to the first target temperature before the image area on the sheet P arrives at the fixing nip portion SN, and therefore, fixing error due to low temperature does not occur.

In the above-described embodiment, the first target temperature is set at 120 degrees C., the second target temperature is set at 90 degrees C., and the third target temperature is set at 80 degrees C., for example. These temperatures are examples only, and the target temperatures are not limited thereto.

With such a structure, unevenness in the temperature on the surface of the fixing member is eliminated and that the formed image quality is improved, thereby also suppressing an excess power supply and reducing power consumption.

By contrast, when the warm-up time for a certain heating element is longer than the predetermined time period, it is determined that the subject heater 56 operates at below average capacity. In this case, there is a concern that the temperature of the subject heating element does not rise to the first target temperature. Therefore, in such a case, the external heat controller sets the third target temperature higher than the second target temperature for the standard heating so as to control the temperature for the fixing member corresponding to the blank areas. As a result, decrease of the temperature on the surface of the fixing member is suppressed and a high quality image without uneven glossiness or uneven fixation can be obtained.

Figure 12:
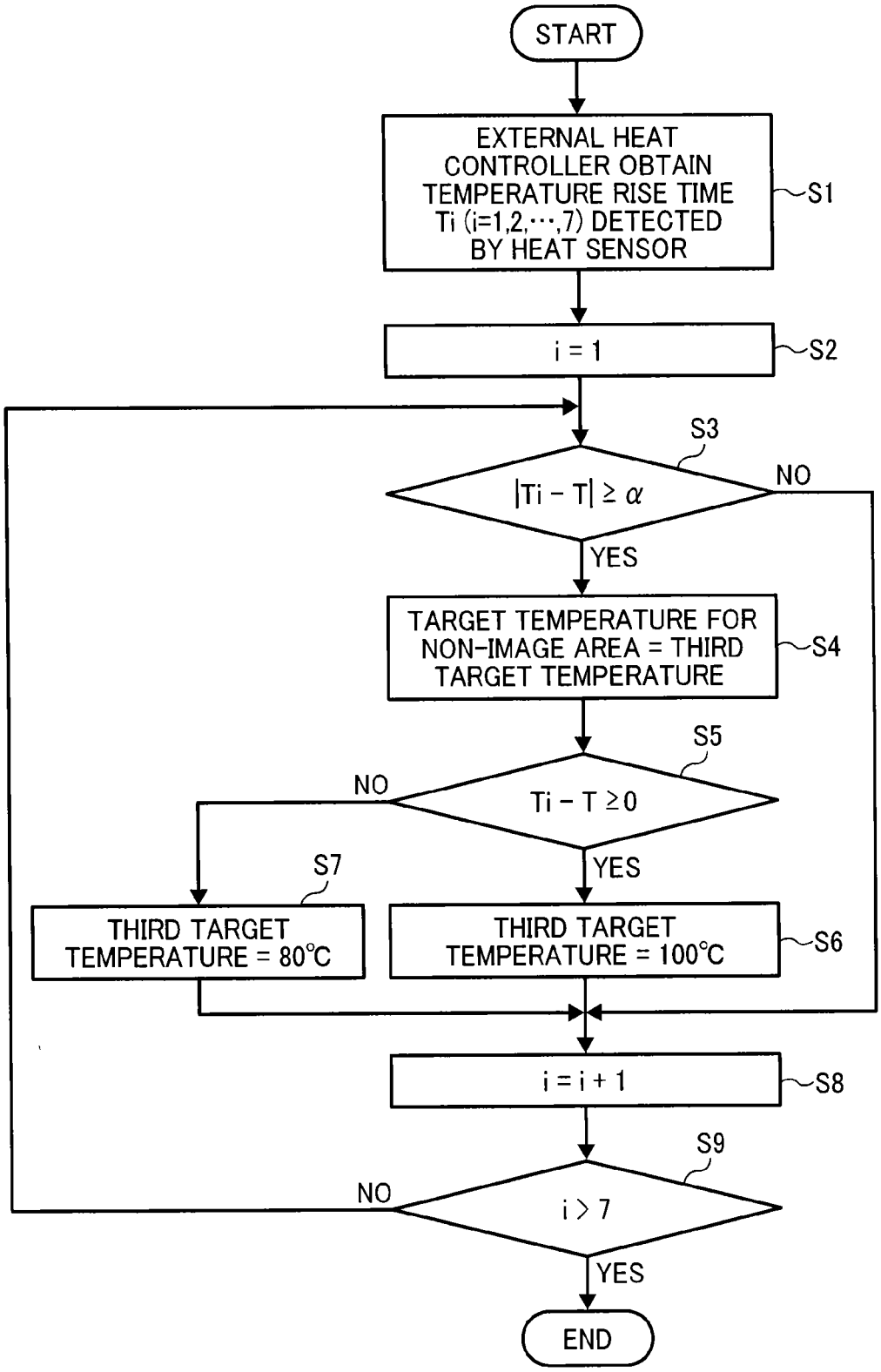
FIG. 12 is a flowchart to determine a target temperature for a blank area.

FIG. 12 is a flowchart illustrating steps in a process of determining a target temperature for a blank area.

Heating elements 56*a* to 56*g* correspond to heating elements 56*i* (i=1 to 7). Initially, for all heating elements $\mathbf{56}_1$ to $\mathbf{56}_7$, the first target temperature 120 degrees C. is set for the image area and the second target temperature 90 degrees C. is set for the blank area. When the printer is activated, all heating elements $\mathbf{56}_1$ to $\mathbf{56}_7$ are activated with the same power up to a certain temperature (for example, the first target temperature). The heat sensor 70 detects the warm-up time Ti (i=1 to 7) of each heating element 56*i*.

Then, the external heat controller 42 obtains Ti (i=1 to 7) (S1), and determines the warm-up time for the heating element $\mathbf{56}_1$ beginning from i=1 (S2). When the difference between the warm-up time $T_1$ and the predetermined time T is less than a threshold $\alpha$ (No in S3), the external heat controller 42 maintains the preset second target temperature 90 degrees C. This is because the difference between the warm-up time $T_1$ and the predetermined time T is minimal, therefore changing the second target temperature is not necessary. On the other hand, if the above difference exceeds the threshold $\alpha$ (Yes in S3), the external heat controller 42 switches the second target temperature for the blank area with the third target temperature (S4). Then, if the warm-up time $T_1$ exceeds the predetermined time T (Yes in S5), the external heat controller 42 determines that the heating performance of the heating element $\mathbf{56}_1$ is inferior and sets the third target temperature at 100 degrees C. On the other hand, if the warm-up time $T_1$ is smaller than the predetermined time T (No in S5), the external heat controller 42 determines that the heating performance of the heating element $\mathbf{56}_1$ is greater than average and sets the third target temperature at 80 degrees C. Successively, the external heat controller 42 moves on to i=2 (S8, S9) and determines the warm-up time of the heating element $\mathbf{56}_2$ (S3). After the above steps S3 to S9 performed repeatedly, the external heat controller 42 sets a target temperature for the image area and the blank area of the heating elements $\mathbf{56}_1$ to $\mathbf{56}_7$, and the process ends.

In the above-described example, the warm-up time of the fixing device 12 is measured to determine the heating of each heating element. Alternatively, for example, the heater 56 may be configured to include a heat generation resistor for each heating element, and the heat sensor 70 can be configured to measure a current that flows when a predetermined voltage is applied to the heat generation resistor. With such a configuration, the heat sensor 70 can determine that, when the detected current is greater than the predetermined current, a greater amount of power is consumed in the heating element and thus, the heating performance is above average. By contrast, when the detected current is smaller than the predetermined current, the heat sensor 70 can determine that the heating performance is below average.

Also, in a configuration in which the fixing member is heated by the IH method, the heat sensor 70 detects the current that flows when the predetermined voltage is applied to the IH excitation coil and determines the heating of each heat generation part. The excitation coil is formed such that 50 to 500 insulation-coated electrical leads each having a diameter $\phi$ of from approximately 0.05 to 0.2 mm are wound together to form a litz wire, which has 5 to 15 windings.

Heretofore, the present invention has been described with reference to drawings, but is not limited to the aforementioned embodiments alone, and can be varied within the scope of the present disclosure and the accompanying claims.

Additional modifications and variations of the present invention are possible in light of the above teachings. It is therefore to be understood that, within the scope of the appended claims, the invention may be practiced other than as specifically described herein.

What is claimed is:

1. A fixing device for an image forming apparatus, comprising:

a rotatable fixing member to rotate while contacting an unfixed image;

a pressure member to press against the fixing member to form a fixing nip in cooperation with the fixing member;

a power supply;

a heating member divided into a plurality of heating elements in a direction perpendicular to a conveyance direction of a sheet of recording medium and to heat the fixing member with power from the power supply;

a heat performance sensor to detect the heating performance of each heating element of the heating member; and a controller to control the heating member, wherein the image is fixed on the recording medium by passing the sheet of recording medium through the nip portion, and wherein the controller is configured to:

control each heating element independently such that a temperature of a portion of the fixing member corresponding to a blank area on the recording medium becomes lower than the temperature of a portion of the fixing member corresponding to an image area on the recording medium; and control the temperature to be maintained at each heating element based on the detected heating performance of each heating element detected by the heat performance sensor.

2. The fixing device as claimed in claim 1, wherein the controller lowers a standby temperature of the heating element having a higher heating performance than a standby temperature of a heating element having a lower heating performance.

3. The fixing device as claimed in claim 1, wherein the controller increases a standby temperature of a heating element having a lower heating performance than a standby temperature of a heating element having a higher heating performance.

4. The fixing device as claimed in claim 1, wherein, when an image forming apparatus is initiated and the fixing device starts to be heated, the heat performance sensor obtains a warm-up time of each heating element of the heating member required to reach a predetermined temperature; and the controller gauges the heating performance of each heating element based on the warm-up time of each heating element.

5. The fixing device as claimed in claim 1, wherein the heating member further comprises a heat generation resistor disposed for each heating element, wherein the heat performance sensor measures a current that flows when a predetermined voltage is applied to the heat generation resistor at each heating element.

6. The fixing device as claimed in claim 1, wherein the heating member employs induction heating and includes an IH excitation coil, wherein the heat performance sensor detects a current that flows when a predetermined voltage is applied to the IH excitation coil and gauges the heating performance of each heating element.

7. The fixing device as claimed in claim 1, wherein the heating member is disposed upstream of the fixing nip relative to a rotation direction of the fixing member.

8. An image forming apparatus comprising a fixing device as claimed in claim 1.

* * * * *

UNITED STATES PATENT AND TRADEMARK OFFICE

CERTIFICATE OF CORRECTION

PATENT NO. : 9,075,357 B2
APPLICATION NO. : 14/174134
DATED : July 7, 2015
INVENTOR(S) : Kazuhito Kishi et al.

It is certified that error appears in the above-identified patent and that said Letters Patent is hereby corrected as shown below:

On the title page, Item (30), the 2nd Foreign Application Priority Data Information has been omitted. Item (30) should read:

--(30) Foreign Application Priority Data

Feb. 14, 2013 (JP) .....2013-026534
Dec. 20, 2013 (JP) .....2013-263684--

Signed and Sealed this
Twenty-fourth Day of November, 2015

Michelle K. Lee

Michelle K. Lee
*Director of the United States Patent and Trademark Office*